US010475598B2

(12) United States Patent
Chang et al.

(10) Patent No.: US 10,475,598 B2
(45) Date of Patent: Nov. 12, 2019

(54) KEYSWITCH STRUCTURE

(71) Applicant: DARFON ELECTRONICS CORP., Taoyuan (TW)

(72) Inventors: Li-Te Chang, Taoyuan (TW); Chih-Chung Yen, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 0 days.

(21) Appl. No.: 16/234,594

(22) Filed: Dec. 28, 2018

(65) Prior Publication Data

US 2019/0206634 A1 Jul. 4, 2019

(30) Foreign Application Priority Data

Jan. 4, 2018 (TW) ..... 107100285 A

(51) Int. Cl.
*H01H 3/12* (2006.01)
*H01H 13/12* (2006.01)
*H01H 13/7065* (2006.01)

(52) U.S. Cl.
CPC ..... *H01H 3/122* (2013.01); *H01H 13/12* (2013.01); *H01H 13/7065* (2013.01)

(58) Field of Classification Search
CPC ..... H01H 3/122; H01H 13/7065; H01H 3/125
USPC ..... 200/5 A, 341, 344, 345
See application file for complete search history.

(56) References Cited

U.S. PATENT DOCUMENTS

| | | | | |
|---|---|---|---|---|
| 6,642,466 | B1 | 11/2003 | Lu | |
| 6,815,627 | B2 | 11/2004 | Chen | |
| 8,164,017 | B2 | 4/2012 | Cheng | |
| 8,642,904 | B2 * | 2/2014 | Chiba | H01H 3/125 200/344 |
| 8,963,034 | B2 | 2/2015 | Liang | |
| 9,508,505 | B2 | 11/2016 | Hsu | |
| 9,773,623 | B2 | 9/2017 | Lin | |
| 2010/0155209 | A1 * | 6/2010 | Cheng | H01H 3/125 200/344 |

FOREIGN PATENT DOCUMENTS

| | | | |
|---|---|---|---|
| TW | 201611060 | A | 3/2016 |
| TW | 201611065 | A | 3/2016 |
| TW | 201724147 | A | 7/2017 |
| TW | 201735080 | A | 10/2017 |
| WO | 95/28727 | A1 | 10/1995 |

* cited by examiner

*Primary Examiner* — Edwin A. Leon
*Assistant Examiner* — Lheiren Mae A Caroc
(74) *Attorney, Agent, or Firm* — Winston Hsu

(57) ABSTRACT

A keyswitch structure includes a keycap, a base plate, a first support, and a second support. The first support and the second support are pivotally connected with each other and are connected to and between the keycap and the base plate. The first support includes a shaft socket, a shaft portion, and a protruding interference portion which are adjacently arranged. Correspondingly, the second support includes a shaft portion, a shaft socket, and a recess interference portion which are adjacently arranged. The recess interference portion has a relief space and a block beside the relief space. The first support and the second support are pivotally connected by engaging the shaft sockets with the corresponding shaft portions; therein, the protruding interference portion is located in the relief space, and the block obstructs the protruding interference portion moving out of the relief space.

10 Claims, 10 Drawing Sheets

KEYSWITCH STRUCTURE

BACKGROUND OF THE INVENTION

1. Field of the Invention

The present invention relates to a keyswitch structure, and more particularly to a keyswitch structure having supports pivotally connecting with each other.

2. Description of the Prior Art

Conventional keyboards include a base plate and a plurality of keycaps disposed above the base plate. Each keycap is connected to the base plate through a lift mechanism in principle so as to move up and down relative to the base plate. A common lift mechanism, e.g. scissors support, is realized by two supports pivotally connecting with each other, e.g. an inner ring support and an outer ring support. The inner ring support is pivotally connected to the inner side of the outer ring support, in general through a hole/shaft fit. For example, the inner support has a shaft protruding outward along a rotation axis at two sides thereof. The outer support has a shaft hole at corresponding inner sides thereof. Then the pivotal connection of the two supports is made by inserting the shafts into the corresponding shaft holes. In practice, at least one of the two supports needs to be deformed so that the shafts can be inserted into the corresponding shaft holes. However, when the keyswitch structure or the lift mechanism is reduced in size, some structural deformation probably remains in the shafts, the shaft holes, or the main bodies of the supports after the two supports are pivotally connected, which affects the stability of movement of the two supports. Presently, there are available lift mechanisms that have pivotally connecting structures that interlock with each other. Therein, the pivotally connecting structure of each of the two supports of the lift mechanism has a shaft portion and a hole portion at the same axis. The pivotal connection of the two supports is achieved by interlocking the shaft portions with the hole portions correspondingly. Because the pivotally connecting structures of the two supports are engaged with each other not mainly through structural deformation in the axis, the above-mentioned residual structural deformation in the axis can be avoided herein. However, in the interlocking structure, the hole portion is provided in a form of an incomplete hole, so that the corresponding hole portion and shaft portion can be engaged with each other smoothly. This structural feature also makes the two engaged supports tend to be disengaged from each other, which affects the stability of the engagement of the two supports and the stability of movement thereof as well. Though the degree of the structural interference of the corresponding hole portion and shaft portion in assembling can be raised to enhance the stability of the engagement of the two supports, it makes the assembling of the pivotally connecting structures of the two supports difficult and makes structural deformation remain in the pivotally connecting structures, which also affects the stability of movement of the two supports.

SUMMARY OF THE INVENTION

In view of the problem in the prior art, the present invention provides a keyswitch structure, of which two supports have pivotally connecting structures that interlock with each other. The pivotally connecting structures further include corresponding interference structures, for reducing axial deformation and enhancing the stability of the engagement of the two supports.

A keyswitch structure according to the invention includes a keycap, a base plate, a first support, and a second support. The base plate is disposed under the keycap. The first support is connected to and between the keycap and the base plate and includes a first main body and a first pivotal connection portion disposed on the first main body. The first pivotal connection portion includes a first shaft socket, a first shaft portion, and a protruding interference portion. The first shaft socket, the first shaft portion, and the protruding interference portion are adjacently arranged along a rotation axis. The second support is connected to and between the keycap and the base plate and includes a second main body and a second pivotal connection portion disposed on the second main body. The second pivotal connection portion includes a recess interference portion, a second shaft socket, and a second shaft portion. The second shaft portion, the second shaft socket, and the recess interference portion are adjacently arranged along the rotation axis. The recess interference portion has a relief space and a block beside the relief space. The first pivotal connection portion and the second pivotal connection portion are pivotally connected by the first shaft portion rotatably disposed in the second shaft socket and the second shaft portion rotatably disposed in the first shaft socket, so that the keycap is capable of moving up and down relative to the base plate through the first support and the second support. Therein, the protruding interference portion is located in the relief space. The block obstructs the protruding interference portion moving out of the relief space. Thereby, the pivotal connection of the first pivotal connection portion and the second pivotal connection portion is achieved mainly by the first shaft portion, the first shaft socket, the second shaft socket, and the second shaft portion. The interaction of the protruding interference portion and the recess interference portion can enhance the stability of the engagement of the first pivotal connection portion and the second pivotal connection portion.

Compared to the prior art, in the keyswitch structure according to the invention, the pivotal connection of the first support and the second support is achieved by the first shaft portion, the first shaft socket, the second shaft socket, and the second shaft portion engaging with each other, which can reduce or avoid the axial deformation in the prior art. Furthermore, the interaction of the protruding interference portion and the recess interference portion can make the engagement of the first pivotal connection portion and the second pivotal connection portion stable, which can avoid the fact in the prior art that the pivotally connecting structures interlocking with each other tend to be disengaged from each other. In other words, the keyswitch structure according to the invention can reduce axial deformation and maintain the stable pivotal connection of the first support and the second support.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
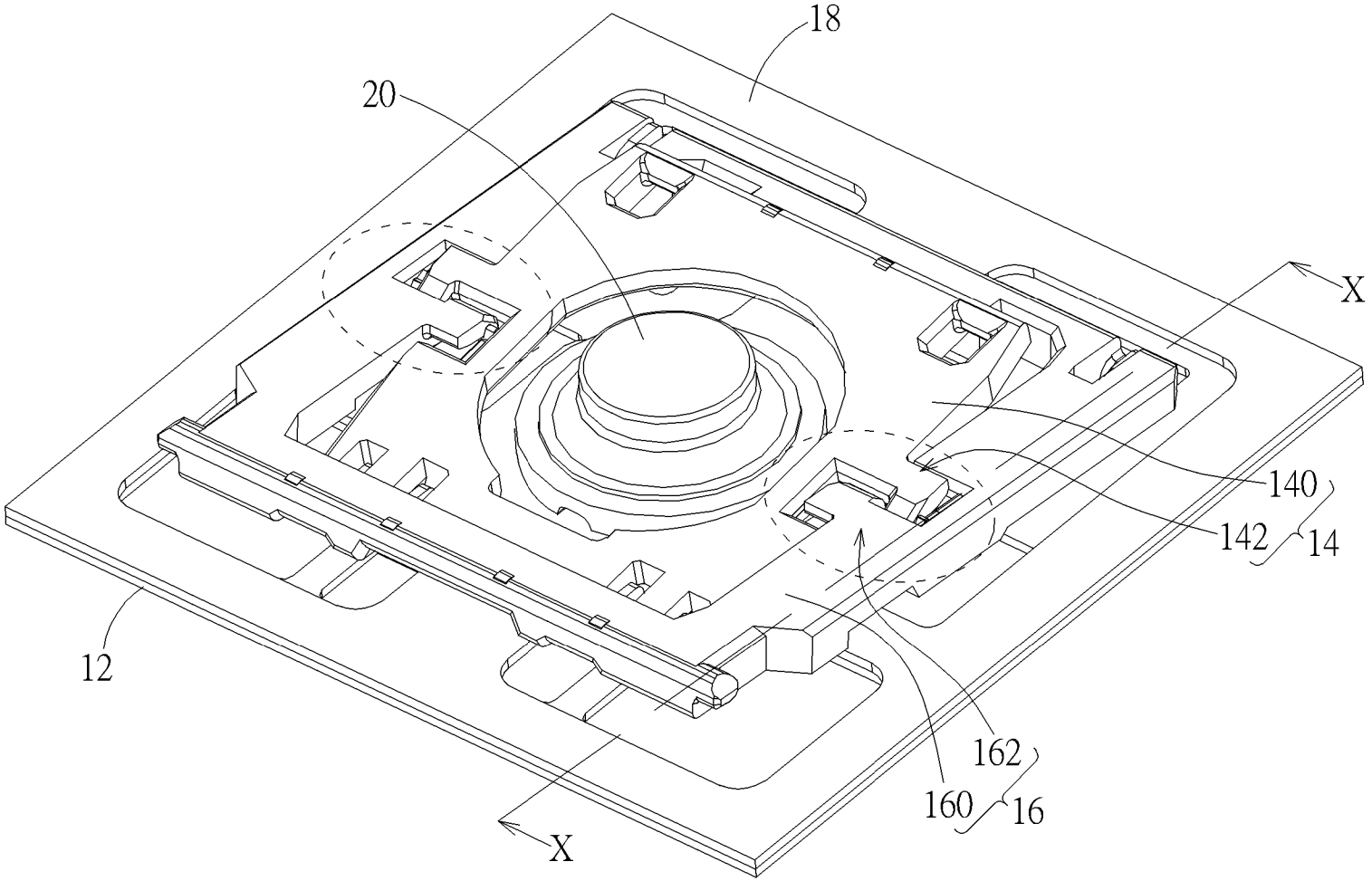
FIG. 1 is a schematic diagram illustrating a keyswitch structure of an embodiment according to the invention; therein, a keycap of the keyswitch structure is not shown.
Figure 2:
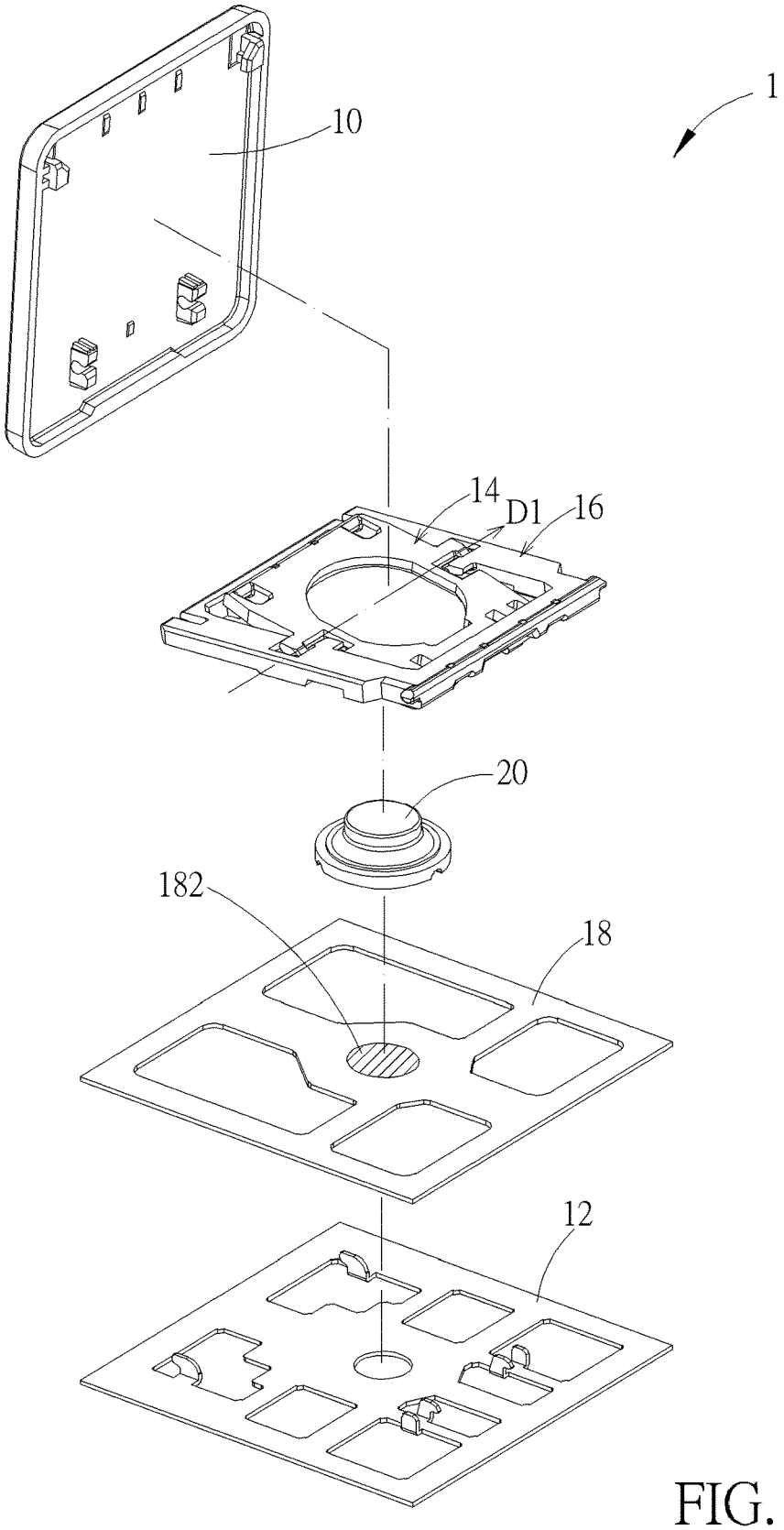
FIG. 2 is an exploded view of the keyswitch structure.
Figure 3:
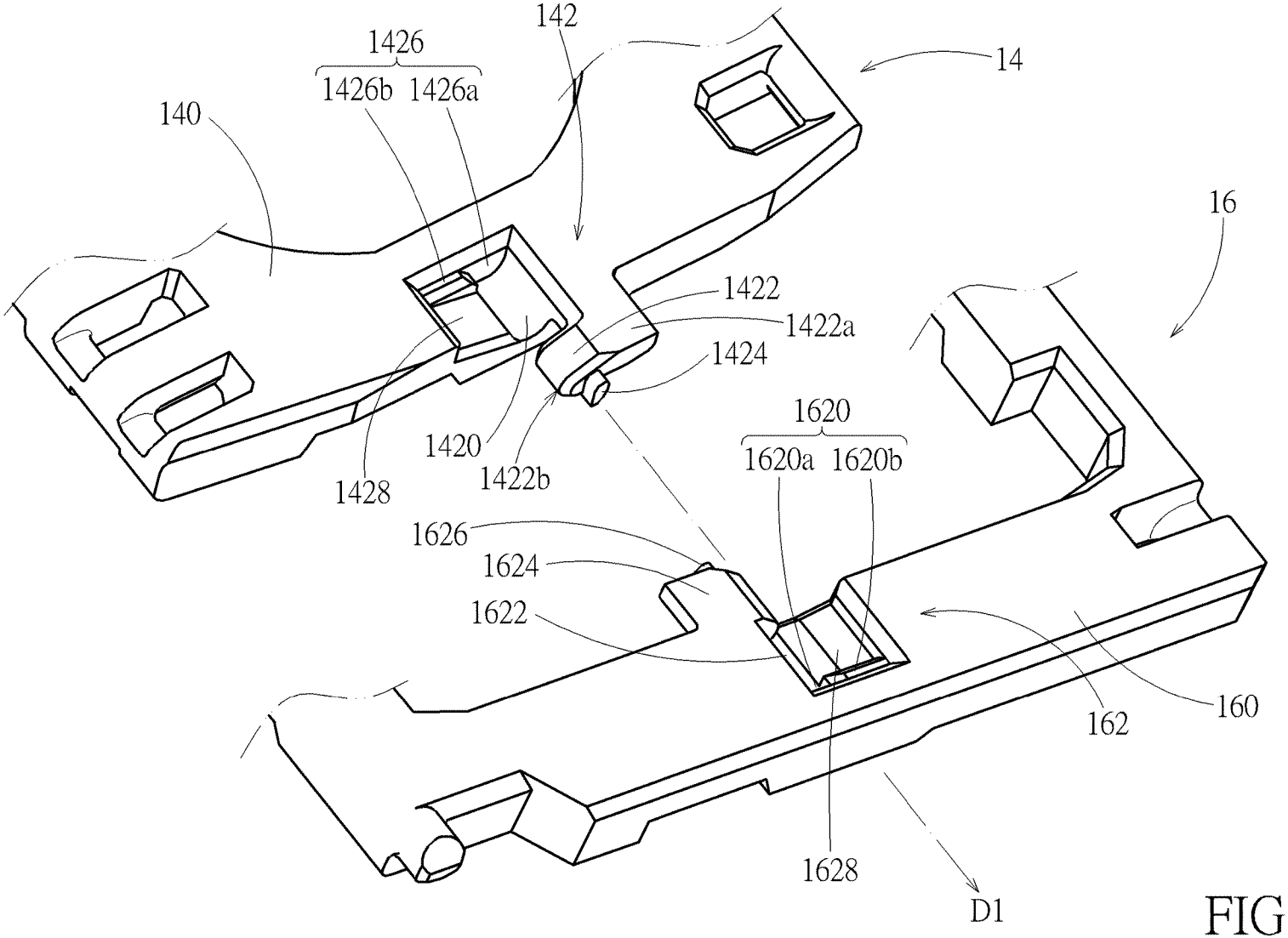
FIG. 3 is an exploded view of a portion of a first support and a second support of the keyswitch structure in FIG. 2.
Figure 4:
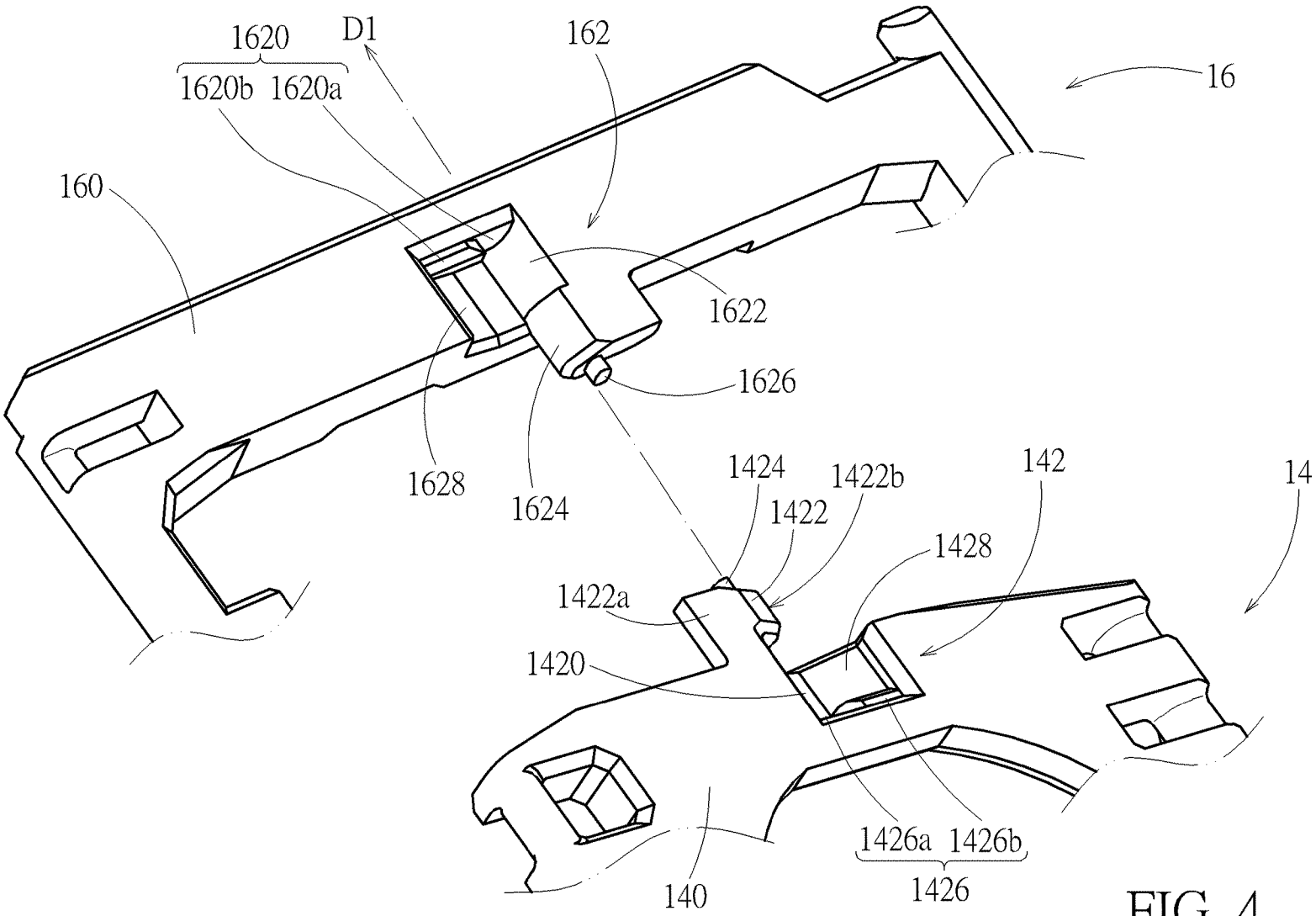
FIG. 4 is a schematic diagram illustrating the first support and the second support in FIG. 3 in another view point.

Please refer to FIG. 1 to FIG. 4. A keyswitch structure 1 of an embodiment according to the invention includes a keycap 10, a base plate 12, a first support 14, a second support 16, a membrane circuit board 18, and an elastic dome 20. The base plate 12 is disposed under the keycap 10. The first support 14 is connected to and between the keycap 10 and the base plate 12. The first support 14 includes a first main body 140 and a first pivotal connection portion 142 disposed on the first main body 140. The first pivotal connection portion 142 includes a first shaft socket 1420, a first shaft portion 1422, and a first protruding interference portion 1424. The second support 16 is connected to and between the keycap 10 and the base plate 12. The second support 16 includes a second main body 160 and a second pivotal connection portion 162 disposed on the second main body 160. The second pivotal connection portion 162 includes a second recess interference portion 1620, a second shaft socket 1622, and a second shaft portion 1624. The second recess interference portion 1620 has a second relief space 1620*a* and a second block 1620*b* beside the second relief space 1620*a*. The first shaft socket 1420, the first shaft portion 1422, and the first protruding interference portion 1424 are adjacently arranged along a rotation axis D1 (indicated by a chain line in the figures). Correspondingly, the second shaft portion 1624, the second shaft socket 1622, and the second recess interference portion 1620 are adjacently arranged along the rotation axis D1. The first pivotal connection portion 142 and the second pivotal connection portion 162 are pivotally connected by the first shaft portion 1422 rotatably disposed in the second shaft socket 1622 and the second shaft portion 1624 rotatably disposed in the first shaft socket 1420, so that the keycap 10 is capable of moving up and down relative to the base plate 12 through the first support 14 and the second support 16. Therein, the first protruding interference portion 1424 is located the second relief space 1620*a*, and the second block 1620*b* obstructs the first protruding interference portion 1424 moving out of the second relief space 1620*a*. The membrane circuit board 18 is disposed on the base plate 12 and includes a switch 182 (indicated by a hatched circle in FIG. 2). In practice, the membrane circuit board 18 can be provided in a form of a conventional three-layer structure. The upper and lower layers thereof are provided with circuitry (including the switch 182) thereon. The middle layer thereof is provided as an insulation layer. For drawing simplification, in FIG. 2, the membrane circuit board 18 is shown by a single plate. The elastic dome 20 is disposed between the membrane circuit board 18 and the keycap 10 corresponding to the switch 182, so that when the keycap 10 is pressed, the elastic dome 20 can be compressed by the keycap 10 to elastically deform and trigger the switch 182, and when the pressed keycap 10 is released, the resilient force produced by the elastically deformed elastic dome 20 can drive the keycap 10 to return to its original position (i.e. move upward away from the base plate 12).

Figure 5:
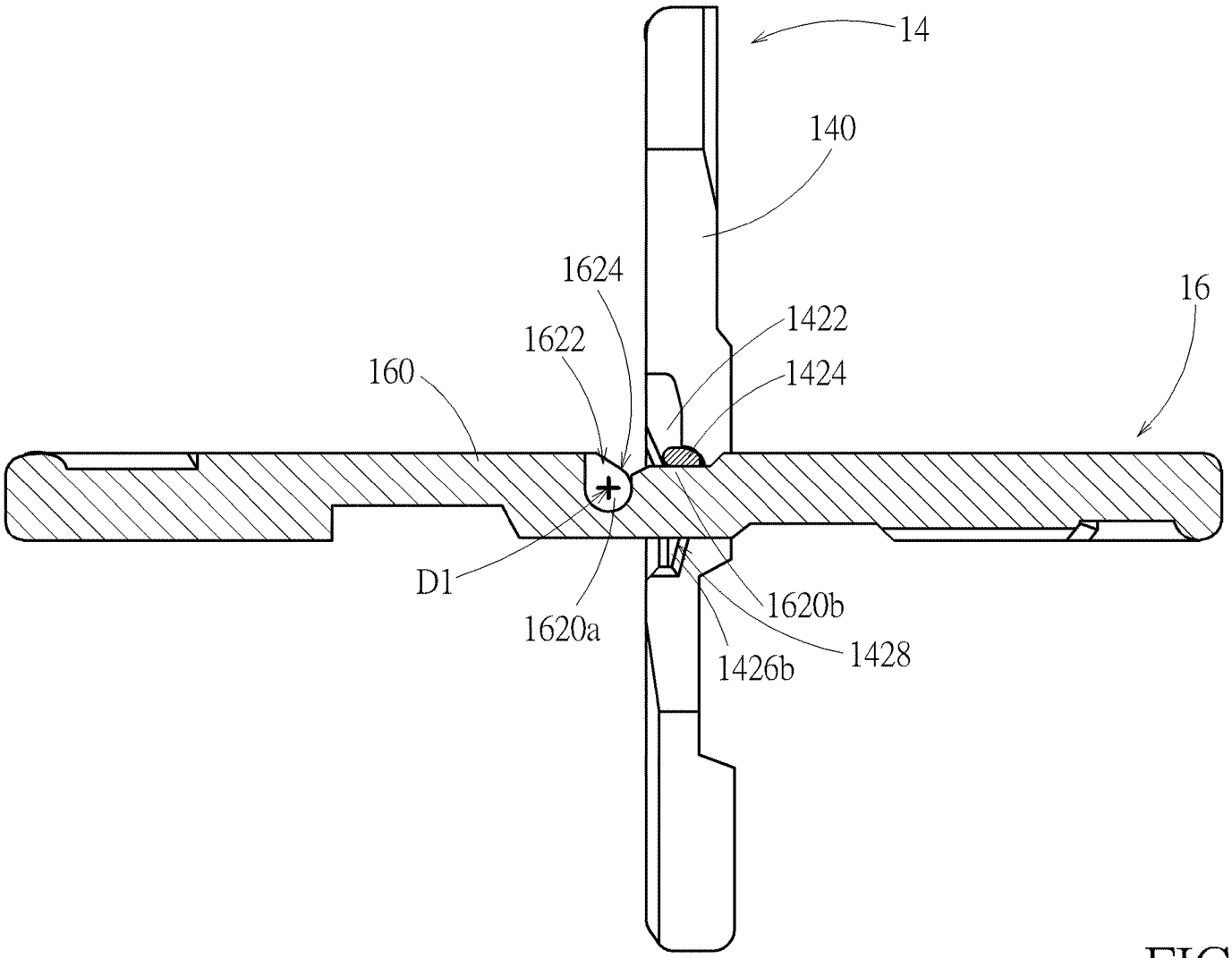
FIG. 5 is a section view of the first support and the second support during assembly, of which the cutting position is equivalent to the line X-X in FIG. 1.
Figure 6:
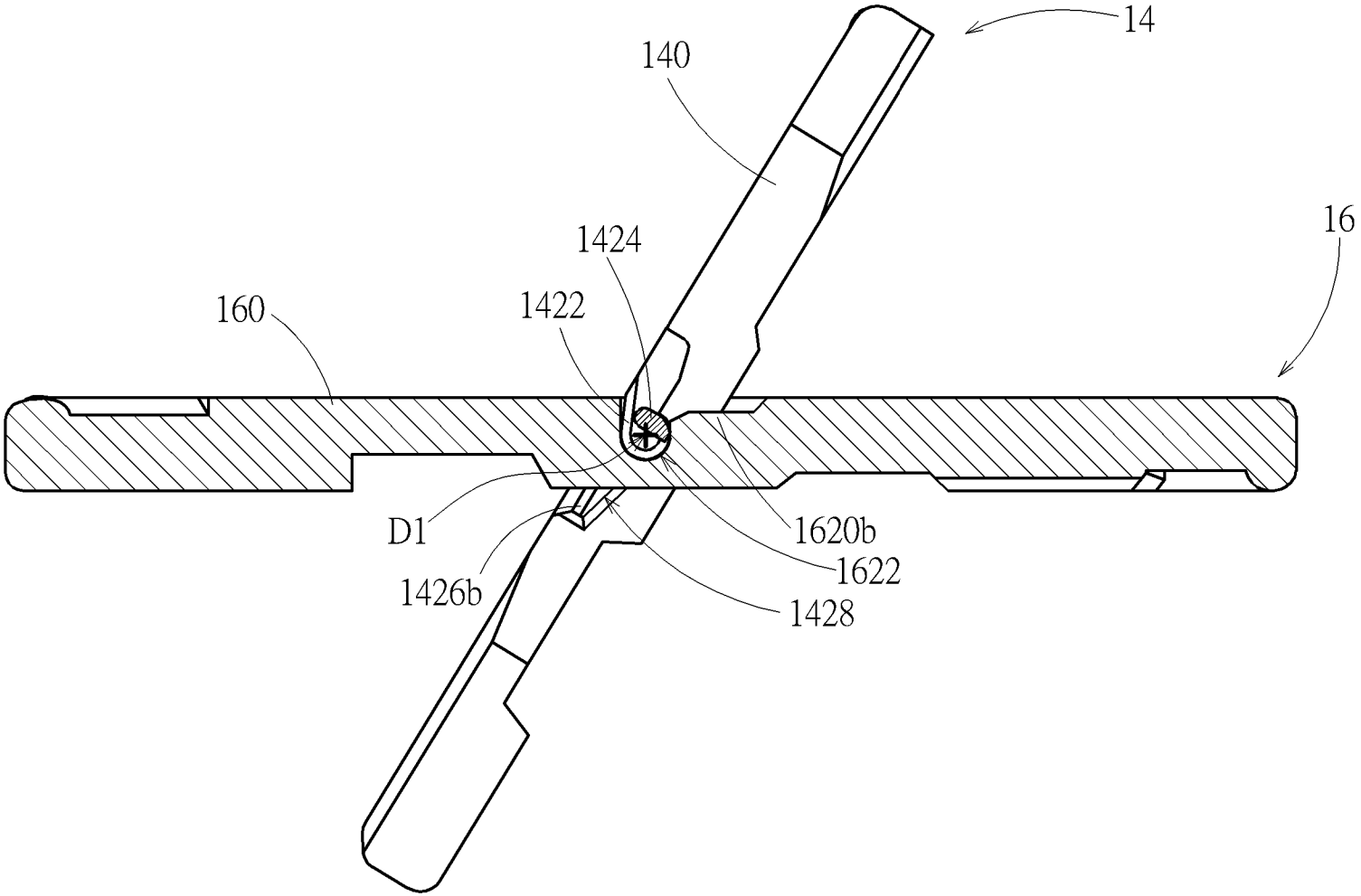
FIG. 6 is a section view of the first support in FIG. 5 which is moved relative to the second support to engage with the second support.

In the embodiment, the second pivotal connection portion 162 includes a second guiding slot 1628. The second guiding slot 1628 extends perpendicular to the rotation axis D1 and is connected to the second shaft socket 1622 and the second relief space 1620*a*. The second block 1620*b* is disposed in the second guiding slot 1628. The second block 1620*b* extends perpendicular to the rotation axis D1. When the first support 14 is ready to be assembled with the second support 16, the first support 14 is placed on the second support 16 in a direction substantially perpendicular to the second support 16. Therein, the first shaft portion 1422 and the first protruding interference portion 1424 are disposed in the second guiding slot 1628, as shown by FIG. 5 (in which the rotation axis D1 is indicated by a cross mark). Then, based on the view point of FIG. 5, the first support 14 is horizontally moved relative to the second support 16 (as shown by the arrow in FIG. 5). Therein, the first shaft portion 1422 horizontally slides in the second guiding slot 1628. The first protruding interference portion 1424 will not interfere with the second block 1620*b* during the sliding. In practice, it is practicable to make the first protruding interference portion 1424 slide on the second block 1620*b*. When the first shaft portion 1422 enters the second shaft socket 1622 from the second guiding slot 1628 (therein, the first protruding interference portion 1424 enters the second relief space 1620*a* from the second guiding slot 1628 at the same time), the first protruding interference portion 1424 structurally interferes with the second block 1620*b*, or the first protruding interference portion 1424 snaps in the second relief space 1620*a*, as shown by FIG. 6. Therefore, after the first pivotal connection portion 142 and the second pivotal connection portion 162 are pivotally connected, the second block 1620*b* can avoid or reduce a possibility of disengagement of the first pivotal connection portion 142 from the second pivotal connection portion 162 by obstructing the first protruding interference portion 1424 (so as to avoid or reduce a possibility of disengagement of the first support 14 from the second support 16). Furthermore, when the first pivotal connection portion 142 and the second pivotal connection portion 162 are pivotally connected, the second shaft portion 1624 also enters the first shaft socket 1420. The pivotal connection of the first pivotal connection portion 142 and the second pivotal connection portion 162 is achieved by the rotatable engagement of the first shaft portion 1422 and the second shaft socket 1622 and the rotatable engagement of the second shaft portion 1624 and the first shaft socket 1420.

Furthermore, in the embodiment, the first shaft portion 1422 and the second shaft socket 1622 are engaged with each other not through a complete round shaft and a complete round hole. In another aspect, the first shaft portion 1422 through an incomplete round shaft is engaged with the second shaft socket 1622 through an incomplete round hole (or an open slot). In logic, the first shaft portion 1422 has a connection portion 1422*a* and a contact portion 1422*b*. The connection portion 1422*a* is connected to other components (e.g. the first shaft socket 1420). The contact portion 1422*b* slidably contacts the second shaft socket 1622. After the first pivotal connection portion 142 and the second pivotal connection portion 162 are pivotally connected, the second guiding slot 1628 also offers relief space to the connection portion 1422*a* (so that when the first support 14 and the second support 16 are relatively rotating within a certain angle range, the connection portion 1422*a* will not structurally interfere with the second support 16). The engagement of the second shaft portion 1624 and the first shaft socket 1420 is the same as described above and will not be described in addition. Furthermore, in the embodiment, in the direction perpendicular to the rotation axis D1, the first protruding interference portion 1424 is located between the connection portion 1422*a* and the contact portion 1422*b*. Further, the first protruding interference portion 1424 is located between the rotation axis D1 and the connection portion 1422*a*. Furthermore, the projection of the first protruding interference portion 1424 in the rotation axis D1 is not beyond the projection of the first shaft portion 1422 in the rotation axis D1 (which can be seen through FIG. 5 or FIG. 6).

Furthermore, in the embodiment, the first pivotal connection portion 142 includes a first recess interference portion 1426 adjacent to the first shaft socket 1420 in the rotation axis D1. The first recess interference portion 1426 has a first relief space 1426*a* and a first block 1426*b* beside the first relief space 1426*a*. The second pivotal connection portion 162 includes a second protruding interference portion 1626 adjacent to the second shaft portion 1624 in the rotation axis D1. The second protruding interference portion 1626 is located in the first relief space 1426*a*. The first block 1426*b* obstructs the second protruding interference portion 1626 moving out of the first relief space 1426*a*. Similarly, after the first pivotal connection portion 142 and the second pivotal connection portion 162 are pivotally connected, the first block 1426*b* can avoid or reduce a possibility of disengagement of the first pivotal connection portion 142 from the second pivotal connection portion 162 by obstructing the second protruding interference portion 1626 (so as to avoid or reduce a possibility of disengagement of the first support 14 from the second support 16). Furthermore, for the description about the structural relationship between the second protruding interference portion 1626 and the second shaft portion 1624, please refer to the relevant descriptions of the structural relationship between the interference portion 1424 and the first shaft portion 1422, which will not be described in addition.

In addition, in the embodiment, the first pivotal connection portion 142 also includes a first guiding slot 1428. The first guiding slot 1428 extends perpendicular to the rotation axis D1 and is connected to the first shaft socket 1420 and the first relief space 1426*a*. The first block 1426*b* is disposed in the first guiding slot 1428. The first block 1426*b* extends perpendicular to the rotation axis D1. Therefore, in practice, when the first support 14 is ready to be assembled with the second support 16, it is practicable to place the second support 16 on the first support 14 in a direction perpendicular to the first support 14. Therein, the second shaft portion 1624 and the second protruding interference portion 1626 are disposed in the first guiding slot 1428. Then, the second support 16 is horizontally moved relative to the first support 14 until the second shaft portion 1624 and the first shaft socket 1420 are engaged. At the moment, the pivotal connection of the first pivotal connection portion 142 and the second pivotal connection portion 162 is completed. Therein, the first shaft portion 1422 and the second shaft socket 1622 are engaged with each other at the same time. The second protruding interference portion 1626 snaps in the first relief space 1426*a*. Furthermore, after the first pivotal connection portion 142 and the second pivotal connection portion 162 are pivotally connected, the first guiding slot 1428 also offers relief space to the second shaft portion 1624 (so that when the first support 14 and the second support 16 are relatively rotating within a certain angle range, the second shaft portion 1624 will not structurally interfere with the first support 14). For other descriptions about the assembly of the second shaft portion 1624 and the second protruding interference portion 1626 to the first shaft socket 1420 and the first relief space 1426*a*, please refer to the relevant descriptions of the assembly of the first shaft portion 1422 and the first protruding interference portion 1424 to the second shaft socket 1622 and the second relief space 1620*a*, which will not be described in addition.

Therefore, in the embodiment, the engagement of the first pivotal connection portion 142 with the second pivotal connection portion 162 is under the structural constraint of the first block 1426*b* (that obstructs the second protruding interference portion 1626) and the second block 1620*b* (that obstructs the first protruding interference portion 1424), however, which is not limited thereto in practice. For example, only one group of structures (e.g. including the first block 1426*b* and the corresponding second protruding interference portion 1626) is used as the structural constraint. Furthermore, in practice, some structural interference is also involved in the assembly of the first shaft portion 1422 to the second shaft socket 1622, so after the first shaft portion 1422 and the second shaft socket 1622 are engaged, the first shaft portion 1422 and the second shaft socket 1622 themselves also has an effect of reducing a possibility of disengagement of the first pivotal connection portion 142 from the second pivotal connection portion 162. Furthermore, in the embodiment, each of the first support 14 and the second support 16 is structurally symmetrical relative to a direction perpendicular to the rotation axis D1, so the first support 14 and the second support 16 are pivotally connected through two sets of the first pivotal connection portion 142 and the second pivotal connection portion 162 (at dashed circles in FIG. 1) substantially, however, which is not limited thereto in practice. For example, the first support 14 and the second support 16 can use only the first block 1426*b* (and the corresponding second protruding interference portion 1626) and the second block 1620*b* (and the corresponding first protruding interference portion 1424), i.e. the structures indicated by the right dashed circle in FIG. 1. For another example, the pivotal connection indicated by the right dashed circle in FIG. 1 uses only the first block 1426*b* (and the corresponding second protruding interference portion 1626) or the second block 1620*b* (and the corresponding first protruding interference portion 1424). Furthermore, in practice, the engagement of the first support 14 and the second support 16 at the left dashed circle in FIG. 1 can be achieved by a shaft and hole fit instead. For example, the first support 14 uses a round shaft, and the second support 16 uses a round hole; therein, any structural constraint like the structural constraint of the second block 1620*b* and the corresponding first protruding interference portion 1424 is not used.

Furthermore, in the embodiment, during the assembly of the first pivotal connection portion 142 to the second pivotal connection portion 162, the first support 14 and the second support 16 elastically deform in a direction perpendicular to the rotation axis D1 (i.e. elastically deform in a radius direction). Roughly speaking, the first shaft portion 1422 and the first protruding interference portion 1424 elastically deform perpendicular to the rotation axis D1 (and the second shaft portion 1624 and the second protruding interference portion 1626 elastically deform perpendicular to the rotation axis D1) so as to engaged the first pivotal connection portion 142 with the second pivotal connection portion 162. Generally speaking, in practice, the first support 14 and the second support 16 can be plastic injection molding parts which have an allowance of elastic deformation to a certain degree for achieving the required elastic deformation for the above engagement. In addition, in practice, during the assembly of the first protruding interference portion 1424 to the second recess interference portion 1620, the second recess interference portion 1620 (or a portion of the second pivotal connection portion 162) also may produce some elastic deformation in the direction perpendicular to the rotation axis D1. This deformation is relatively small and, therefore, is not mentioned in particular in the description for simplification of the embodiments. The above description is also applied to the engagement of the second protruding interference portion 1626 with the first recess interference portion 1426.

Figure 7:
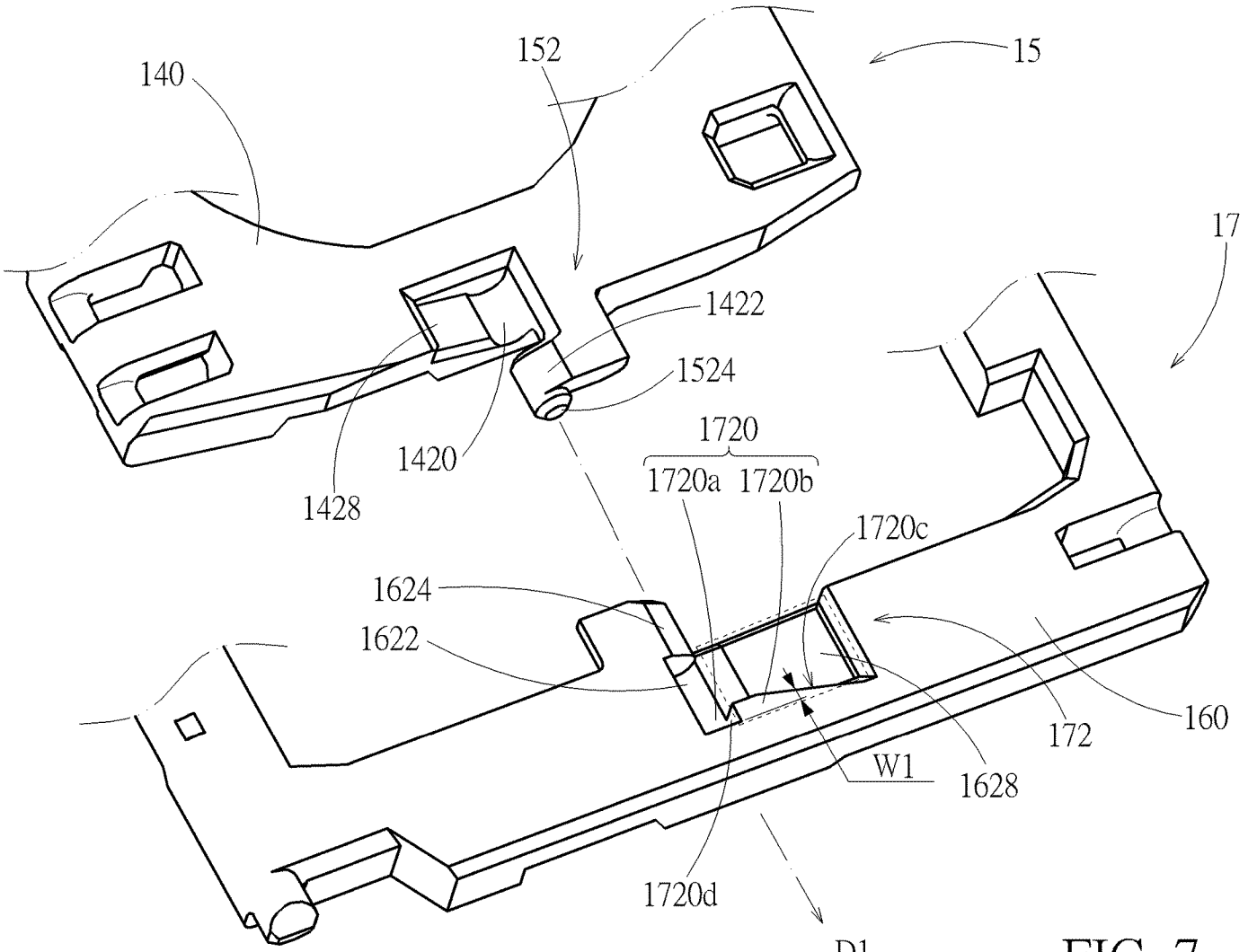
FIG. 7 is an exploded view of a portion of a first support and a second support according to another embodiment.
Figure 8:
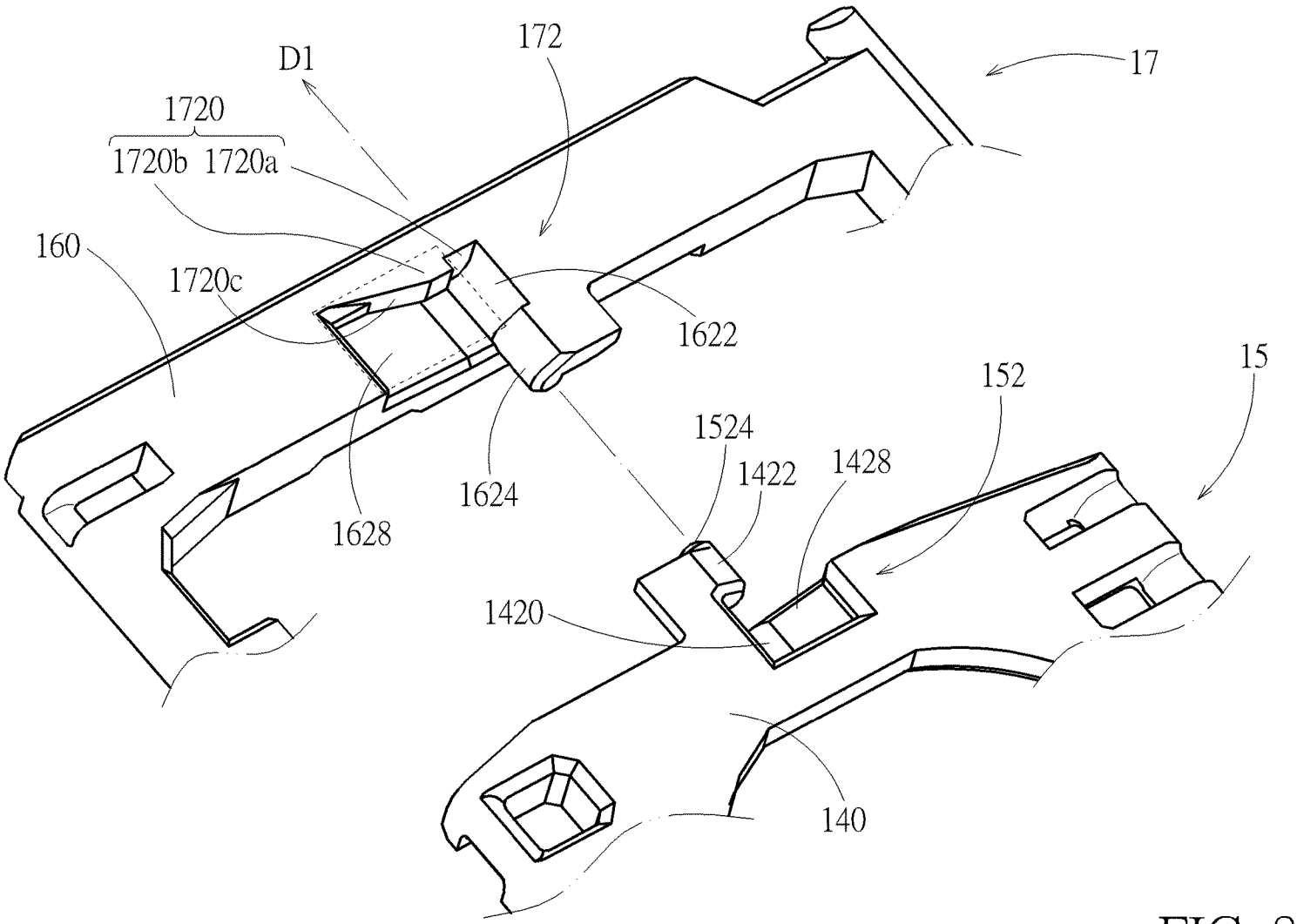
FIG. 8 is a schematic diagram illustrating the first support and the second support in FIG. 7 in another view point.

In the embodiment, the interference structures (i.e. the first protruding interference portion 1424 and the corresponding second recess interference portion 1620) for preventing the first pivotal connection portion 142 from being disengaged from the second pivotal connection portion 162 elastically deform in a radius direction so as to be engaged with each other. However, in practice, the engagement of the first pivotal connection portion 142 and the second pivotal connection portion 162 also can be achieved by different interference structures that elastically deform axially (i.e. parallel to the rotation axis D1) to be engaged with each other. As shown by FIG. 7 and FIG. 8, according to another embodiment, a first support 15 and a second support 17 are structurally symmetrical relative to a direction perpendicular and similar to the above-mentioned first support 14 and the above-mentioned second support 16 respectively, so the first support 15 and the second support 17 still use the reference numbers of the first support 14 and the second support 16 respectively. Therefore, for other descriptions about the first support 15 and the second support 17, please refer to the relevant descriptions of the first support 14 and the second support 16 (including the descriptions about the engagement thereof and the variations of the correspondingly structures thereof), which will not be described in addition. The first support 15 and the first support 14 differ mainly in the fact that a first protruding interference portion 1524 of a first pivotal connection portion 152 of the first support 15 is provided in a form of a column and extends along the rotation axis D1. The second support 17 and the second support 16 differ mainly in the fact that a second block 1720*b* of a second recess interference portion 1720 of a second pivotal connection portion 172 of the second support 17 is provided in a form of a wedge structure, of which a width W1 in a direction parallel to the rotation axis D1 varies incrementally in a direction toward the rotation axis D1. When the first support 15 is ready to be assembled with the second support 17, the first shaft portion 1422 of the first pivotal connection portion 152 is placed in the second guiding slot 1628 of the second pivotal connection portion 172 (indicated by a dashed rectangle for its accommodating space, for convenience of comparing with the second guiding slot 1628 of the second support 16; therein, the second block 1720*b* is disposed in the second guiding slot 1628 in logic). An end of the first protruding interference portion 1524 abuts against an oblique side wall surface 1720*c* of the second block 1720*b* (which obliquely extends relative to a direction perpendicular to the rotation axis D1). Then, the first support 15 is moved relative to the second support 17, so that the first shaft portion 1422 slides in the second guiding slot 1628. An end of the first protruding interference portion 1524 slides on the oblique side wall surface 1720*c* of the second block 1720*b*, so that the first pivotal connection portion 152 elastically deforms in the rotation axis D1. The first support 15 moves relative to the second support 17, until the end of the first protruding interference portion 1524 departs from the oblique side wall surface 1720*c* of the second block 1720*b* and the first pivotal connection portion 142 fits in the second relief space 1720*a* of the second recess interference portion 1720. At the moment, the pivotal connection of the first pivotal connection portion 152 and the second pivotal connection portion 172 is completed. Similarly, the second block 1720*b* can obstruct the first protruding interference portion 1524 by the wall surface 1720*d* that is substantially parallel to the rotation axis D1, so as to avoid or reduce a possibility of disengagement of the first pivotal connection portion 152 from the second pivotal connection portion 172 (so as to avoid or reduce a possibility of disengagement of the first support 15 from the second support 17).

Furthermore, in practice, the assembly of the first protruding interference portion 1524 to the second recess interference portion 1720, the second recess interference portion 1720 (or a portion of the second pivotal connection portion 162) also may produce some elastic deformation in the direction perpendicular to the rotation axis D1. This deformation is relatively small and, therefore, is not mentioned in particular in the description for simplification of the embodiment. In addition, for simplification of the description, in the embodiment, the first pivotal connection portion 152 does not include a recess interference structure, and the second pivotal connection portion 172 does not include a corresponding protruding interference portion either. However, in practice, the first pivotal connection portion 152 also can include a structure like the above-mentioned second recess interference portion 1720 (or the recess interference portion 1620), and the second pivotal connection portion 172 can include a corresponding structure like the above-mentioned first protruding interference portion 1524 (or the protruding interference portion 1424).

Figure 9:
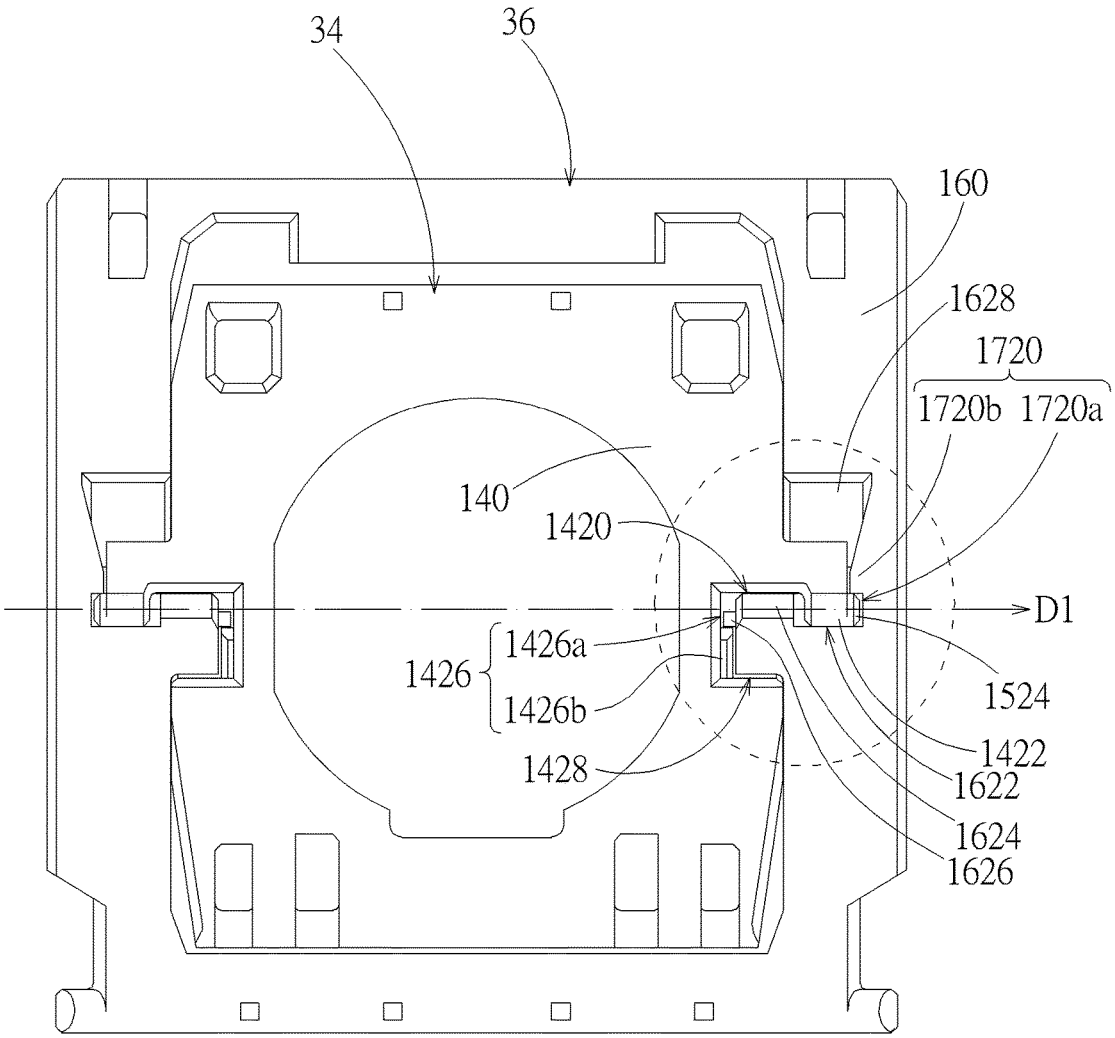
FIG. 9 is a top view of a first support and a second support after assembled according to another embodiment.

In practice, the first support 14 and the second support 16 of the keyswitch structure 1 can be replaced with the first support 15 and the second support 17. In the first support 14 and the second support 16, it is not limited thereto in practice. For example, as shown by FIG. 9, a first support 34 and a second support 36 use the two interference structures for preventing disengagement at the same time. Therein, the first support 34 is structurally similar to the first supports 14 and 15. The second support 36 is structurally similar to the second supports 16 and 17. Therefore, the first support 34 and the second support 36 still use the reference numbers of the first support 14 and the second support 16 respectively. Therefore, for other descriptions about the first support 34 and the second support 36, please refer to the relevant descriptions of the first supports 14 and 15 and the second supports 16 and 17 (including the descriptions about the engagement thereof and the variations of the correspondingly structures thereof), which will not be described in addition. Furthermore, in the embodiment, each of the first support 34 and the second support 36 is structurally symmetrical relative to a direction perpendicular to the rotation axis D1, so the following description is based on a right pivotal connection (indicated by a dashed circle) in FIG. 9. At the right pivotal connection, the engagement of the first protruding interference portion 1524 with the second recess interference portion 1720 at the right side is achieved by axially elastically deforming the first shaft portion 1422. The engagement of the second protruding interference portion 1626 with the first recess interference portion 1426 at the left side is achieved by radially elastically deforming the second shaft portion 1624. In practice, it is practicable to achieve the engagement of the first support 34 and the second support 36 by using different interference structures for preventing disengagement and different pivotally connecting structures (e.g. a round hole and a round shaft at left pivotal connection) at the left and right pivotal connections.

Figure 10:
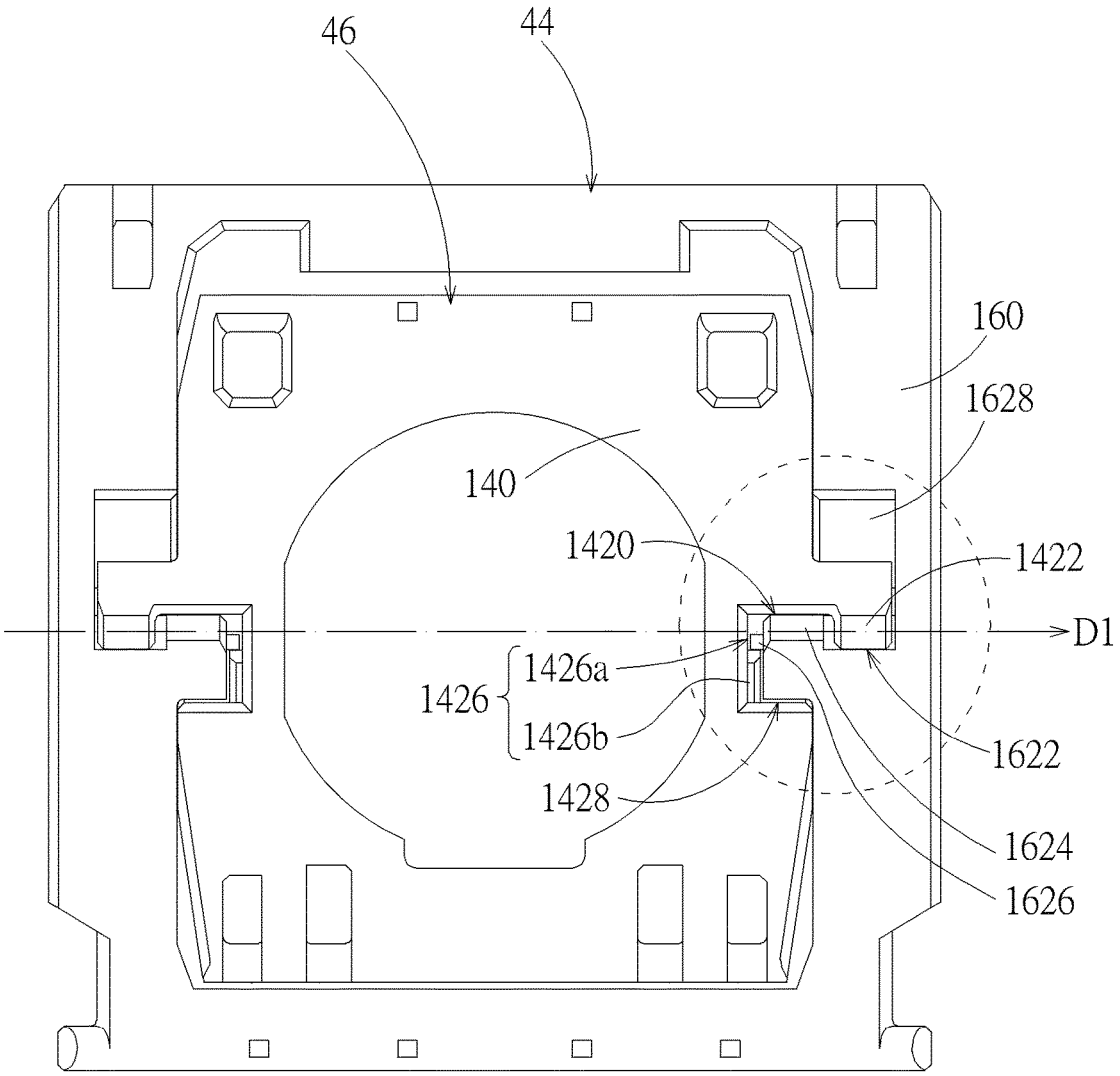
FIG. 10 is a top view of a first support and a second support after assembled according to another embodiment.

In addition, the above embodiments are based on the fact that the first supports 14, 15 and 34 are an inner ring support, the second supports 16, 17 and 36 are an outer ring support, and the first supports 14, 15 and 34 are located inside the second supports 16, 17 and 36, however, which is not limited thereto in practice. For example, as shown by FIG. 10, a first support 44 is an outer ring support. A second support 46 is an inner ring support. The second support 46 is located inside the first support 44. Therein, each of the first support 44 and the second support 46 is structurally symmetrical relative to a direction perpendicular to the rotation axis D1, so the following description is based on a right pivotal connection (indicated by a dashed circle) in FIG. 10. At the right pivotal connection, no interference structure is used at the right side. An interference structure like the above-mentioned second protruding interference portion 1626 and corresponding first recess interference portion 1426 (or in structural logic, like the above-mentioned first protruding interference portion 1424 and corresponding second recess interference portion 1620) is used at the left side. However, in practice, at the right pivotal connection, an interference structure can be used in the left and right sides. In the embodiment, for convenience of drawing reading, the first support 44 and the second support 46 still use the reference numbers of the first support 14 and the second support 16 respectively. Therefore, for other descriptions about the first support 44 and the second support 46, please refer to the relevant descriptions of the first support 14 and the second support 16, which will not be described in addition. In brief, after the first support 44 and the second support 46 are pivotally connected, the first block 1426*b* can obstruct the second protruding interference portion 1626 moving out of the first relief space 1426*a*, so as to avoid or reduce a possibility of disengagement of the first support 44 from the second support 46. In addition, the above-mentioned relevant descriptions of the second support 16 and the first support 14 and the variations thereof are also applied herein, which will not be described in addition.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch structure, comprising:

a keycap;

a base plate, disposed under the keycap; and a first support, connected to and between the keycap and the base plate, the first support comprising a first main body and a first pivotal connection portion disposed on the first main body, the first pivotal connection portion comprising a first shaft socket, a first shaft portion, and a first protruding interference portion, the first shaft socket, the first shaft portion, and the first protruding interference portion being adjacently arranged along a rotation axis; and a second support, connected to and between the keycap and the base plate, the second support comprising a second main body and a second pivotal connection portion disposed on the second main body, the second pivotal connection portion comprising a second recess interference portion, a second shaft socket, and a second shaft portion, the second shaft portion, the second shaft socket, and the second recess interference portion being adjacently arranged along the rotation axis, the second recess interference portion having a second relief space and a second block beside the second relief space, the first pivotal connection portion and the second pivotal connection portion being pivotally connected by the first shaft portion rotatably disposed in the second shaft socket and the second shaft portion rotatably disposed in the first shaft socket, so that the keycap is capable of moving up and down relative to the base plate through the first support and the second support, wherein the first protruding interference portion is located in the second relief space, and the second block obstructs the first protruding interference portion moving out of the second relief space.

2. The keyswitch structure according to claim 1, wherein the second pivotal connection portion comprises a second guiding slot, the second guiding slot extends perpendicular to the rotation axis and is connected to the second shaft socket and the second relief space, and the second block is disposed in the second guiding slot.

3. The keyswitch structure according to claim 2, wherein the second block extends perpendicular to the rotation axis.

4. The keyswitch structure according to claim 2, wherein the second block is a wedge structure, and a width of the wedge structure in a direction parallel to the rotation axis varies incrementally in a direction toward the rotation axis.

5. The keyswitch structure according to claim 1, wherein the first pivotal connection portion comprises a first recess interference portion adjacent to the first shaft socket in the rotation axis, the first recess interference portion has a first relief space and a first block beside the first relief space, the second pivotal connection portion comprises a second protruding interference portion adjacent to the second shaft portion in the rotation axis, the second protruding interference portion is located in the first relief space, and the first block obstructs the second protruding interference portion moving out of the first relief space.

6. The keyswitch structure according to claim 5, wherein the first pivotal connection portion comprises a first guiding slot, the first guiding slot extends perpendicular to the rotation axis and is connected to the first shaft socket and the first relief space, and the first block is disposed in the first guiding slot.

7. The keyswitch structure according to claim 6, wherein the first block extends perpendicular to the rotation axis.

8. The keyswitch structure according to claim 6, wherein the first block is a wedge structure, and a width of the wedge structure in a direction parallel to the rotation axis varies incrementally in a direction toward the rotation axis.

9. The keyswitch structure according to claim 1, wherein a projection of the first protruding interference portion in the rotation axis is not beyond a projection of the first shaft portion in the rotation axis.

10. The keyswitch structure according to claim 1, wherein the first support is an inner ring support, the second support is an outer ring support, and the first support is located inside the second support.

* * * * *